US011159889B2

(12) United States Patent
Yan et al.

(10) Patent No.: US 11,159,889 B2
(45) Date of Patent: Oct. 26, 2021

(54) SOUNDING DEVICE

(71) Applicant: AAC Technologies Pte. Ltd., Singapore (SG)

(72) Inventors: Xudong Yan, Shenzhen (CN); Keyong Zhou, Shenzhen (CN); Wei Liu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/993,271

(22) Filed: Aug. 14, 2020

(65) Prior Publication Data

US 2021/0006905 A1 Jan. 7, 2021

Related U.S. Application Data

(63) Continuation of application No. PCT/CN2019/094140, filed on Jul. 1, 2019.

(51) Int. Cl.
*H04R 9/02* (2006.01)
*H04R 9/06* (2006.01)
*H04R 1/02* (2006.01)

(52) U.S. Cl.
CPC ..... *H04R 9/025* (2013.01); *H04R 1/025* (2013.01); *H04R 9/06* (2013.01)

(58) Field of Classification Search
CPC ..... H04R 9/025; H04R 1/025; H04R 9/06
USPC ..... 381/335
See application file for complete search history.

(56) References Cited

U.S. PATENT DOCUMENTS

2004/0136558 A1* 7/2004 Usuki ..... H04R 9/047 381/394
2008/0019558 A1* 1/2008 Simidian ..... H04R 9/047 381/408
2010/0322458 A1* 12/2010 Takewa ..... H04R 7/02 381/398
2016/0381463 A1* 12/2016 Wang ..... H04R 9/025 381/400
2018/0132041 A1* 5/2018 Lim ..... H04R 9/06

* cited by examiner

*Primary Examiner* — Sean H Nguyen
(74) *Attorney, Agent, or Firm* — W&G Law Group

(57) ABSTRACT

A sounding device includes a first housing having a first receiving space with a first opening end; a second housing disposed opposite to and spaced apart from the first housing, the second housing having a second receiving space with a second opening end facing the first opening end, the second housing comprising an end wall opposite to the second opening end; a magnetically conductive core received in the second receiving space and fixed to the end wall; a coil received in the second receiving space and wound around the magnetically conductive core; a first magnet received in the first receiving space; a second magnet received in the second receiving space, the second magnet being located at outside of the coil and spaced apart from the coil; and a third magnet received in the first receiving space and disposed on a peripheral side of the first magnet.

16 Claims, 4 Drawing Sheets

SOUNDING DEVICE

CROSS REFERENCE TO RELATED APPLICATIONS

This non-provisional patent application is a continuation application of International Application PCT/CN2019/094140, filed on Jul. 1, 2019, the content of which is incorporated herein by reference.

FIELD OF THE INVENTION

The present disclosure relates to the field of electroacoustic conversion, and in particular to a sounding device.

BACKGROUND

With the advent of the Internet era, more and more electronic devices including portable mobile phones are gradually taking up everyone's life, and the functions of mobile phones are becoming more and more diverse, wherein the high-quality sounding function of mobile phones is also one of key functions to consider when people buy mobile phones. At present, with the development of touch-screen mobile phones, more and more screen sounders are also used in smart phones, i.e., a smart phone with screen sounding, in which high-quality sound can be heard when the ear of the user is close to the screen at any position, which not only facilitates picking up but also makes the call clearer. As a sounding device, an exciter is a key component to realize sounding of the screen, and rapid application of sounding technology of the screen makes a high-performance exciter particularly important.

In related art, the design of high-efficiency magnetic circuit requires the screen to withstand a great attractive force generated by the magnetic circuit, and imposes a high assembly requirement for the screen and middle frame of a smart phone, which reduces the reliability and assembling ability of the screen.

Therefore, there is a desire to provide an improved sounding device which overcomes the above problems.

SUMMARY

Accordingly, the present disclosure is directed to an improved sounding device with a reduced internal attractive force between two parts thereof.

In one aspect, the present disclosure provides a sounding device which comprises a first housing having a first receiving space with a first opening end; a second housing disposed opposite to and spaced apart from the first housing, the second housing having a second receiving space with a second opening end facing the first opening end, the second housing comprising an end wall opposite to the second opening end; a magnetically conductive core received in the second receiving space and fixed to the end wall; a coil received in the second receiving space and wound around the magnetically conductive core; a first magnet received in the first receiving space; a second magnet received in the second receiving space, the second magnet being located at outside of the coil and spaced apart from the coil; and a third magnet received in the first receiving space and disposed on a peripheral side of the first magnet.

In some embodiments, both the first housing and the second housing are made of magnetic conductive material.

In some embodiments, when the coil is energized, one of the second housing and the first housing is vibrated in a vibration direction relative to the other of the second housing and the first housing, the vibration direction being parallel to an axis of the coil around which the coil is wound.

In some embodiments, the second magnet comprises two magnets which are disposed on and spaced from opposite sides of the coil respectively.

In some embodiments, the second magnet is magnetized in a direction perpendicular to the vibration direction, and the magnetization directions of the two magnets are opposite to each other.

In some embodiments, a projection of the third magnet in the vibration direction at least partially overlaps a projection of the second magnet in the vibration direction.

In some embodiments, the third magnet comprises two magnets which are closely arranged on opposite sides of the first magnet respectively.

In some embodiments, the third magnet is magnetized in a direction perpendicular to the vibration direction, and the magnetization directions of the two third magnets are opposite to each other.

In some embodiments, the first magnet is magnetized in the vibration direction.

In some embodiments, the sounding device further comprises an elastic support member connected between the first housing and the second housing in the vibration direction.

In some embodiments, the elastic support member comprises a first support plate connected with the second housing, a second support plate connected with the first housing and a support ring connecting the first support plate and the second support plate.

In some embodiments, the support ring comprises a first surface and a second surface opposite to each other, the first support plate is fixed to the first surface and connected with the second housing, and the second support plate is fixed to the second surface.

In some embodiments, the support ring has a rectangular ring shape with a long axis and a short axis perpendicular to the long axis, the first support plate and the second support plate each includes two support plates, the two first support plates are symmetrically fixed to the first surface of the support ring along the long axis of the support ring and connected with the second housing, and the two second support plates are symmetrically fixed to the second surface of the support ring along the short axis of the support ring and connected with the first housing.

In some embodiments, the support ring is an annular spring.

In some embodiments, the first magnet, the second magnet, and the third magnet are all permanent magnets.

In another aspect, the present disclosure provides an electronic device comprising a sounding device described above.

Compared with the related art, two parts of the sounding device provided by the present disclosure are connected by a spring, which realizes the integrity of the split direct driving type sounding device, reduces the assembly requirement for the screen. The magnetic circuit using five magnets is applied between the upper and first housings to cause the internal attractive forces of the sounding device to be counteracted with each other, which reduces the assembly requirement for the screen, realizes the applicability of different types of screens, and protects the screen effectively.

BRIEF DESCRIPTION OF THE DRAWINGS

In order to explain the technical solutions of the embodiments of the present disclosure more clearly, accompanying drawings used to describe the embodiments are briefly introduced below. It is evident that the drawings in the following description are only concerned with some embodiments of the present disclosure. For those skilled in the art, in a case where no inventive effort is made, other drawings may be obtained based on these drawings.

DESCRIPTION OF THE EMBODIMENTS

Figure 1:
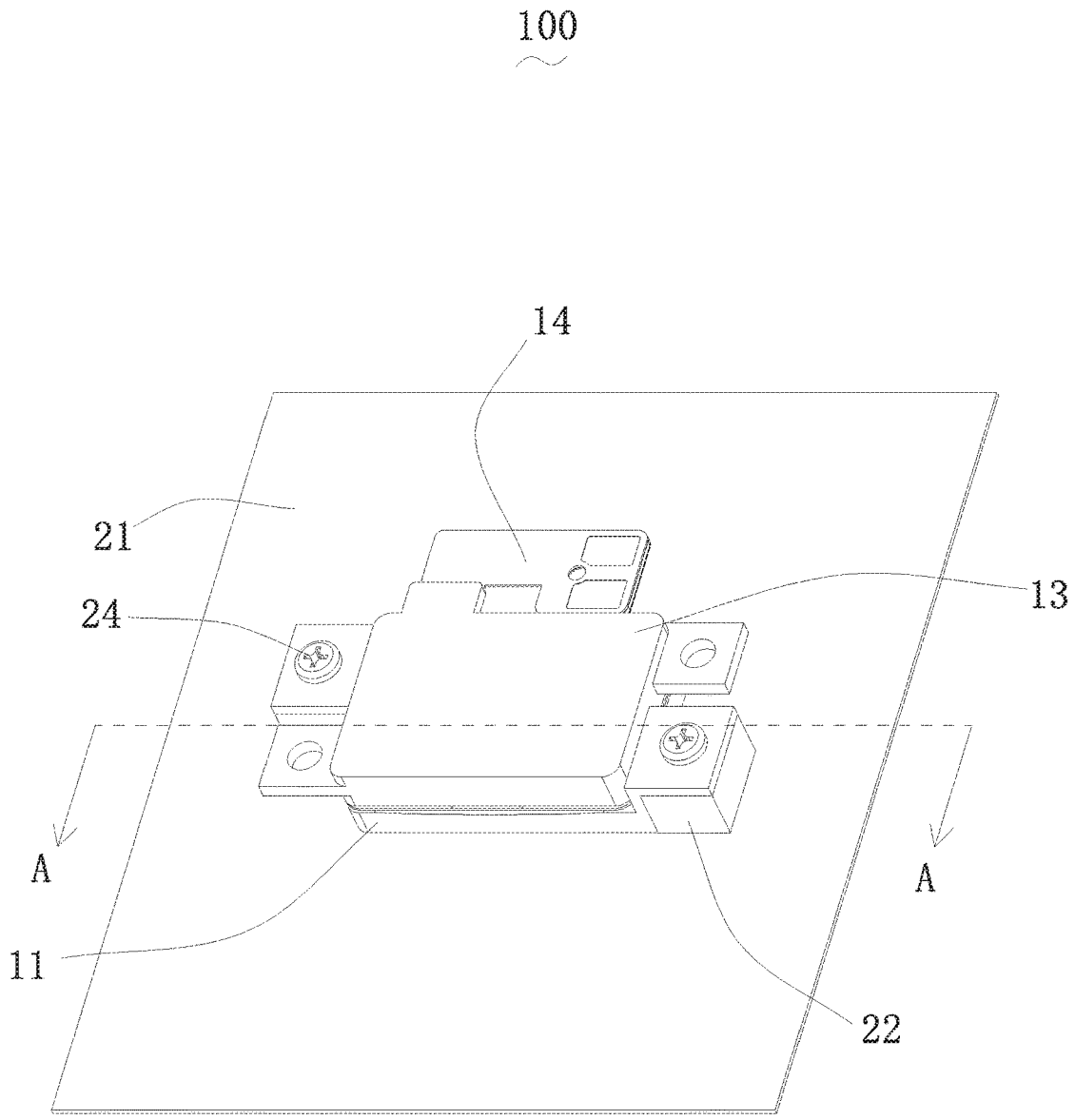
FIG. 1 is a schematic perspective view of a sounding device according to an exemplary embodiment of the present disclosure.

The present disclosure will be further illustrated with reference to the accompanying drawings. It shall be noted that the elements of similar structures or functions are represented by like reference numerals throughout the figures. The embodiments described herein are not intended as an exhaustive illustration or description of various other embodiments or as a limitation on the scope of the claims or the scope of some other embodiments that are apparent to one of ordinary skills in the art in view of the embodiments described in the Application. In addition, an illustrated embodiment need not have all the aspects or advantages shown.

Figure 2:
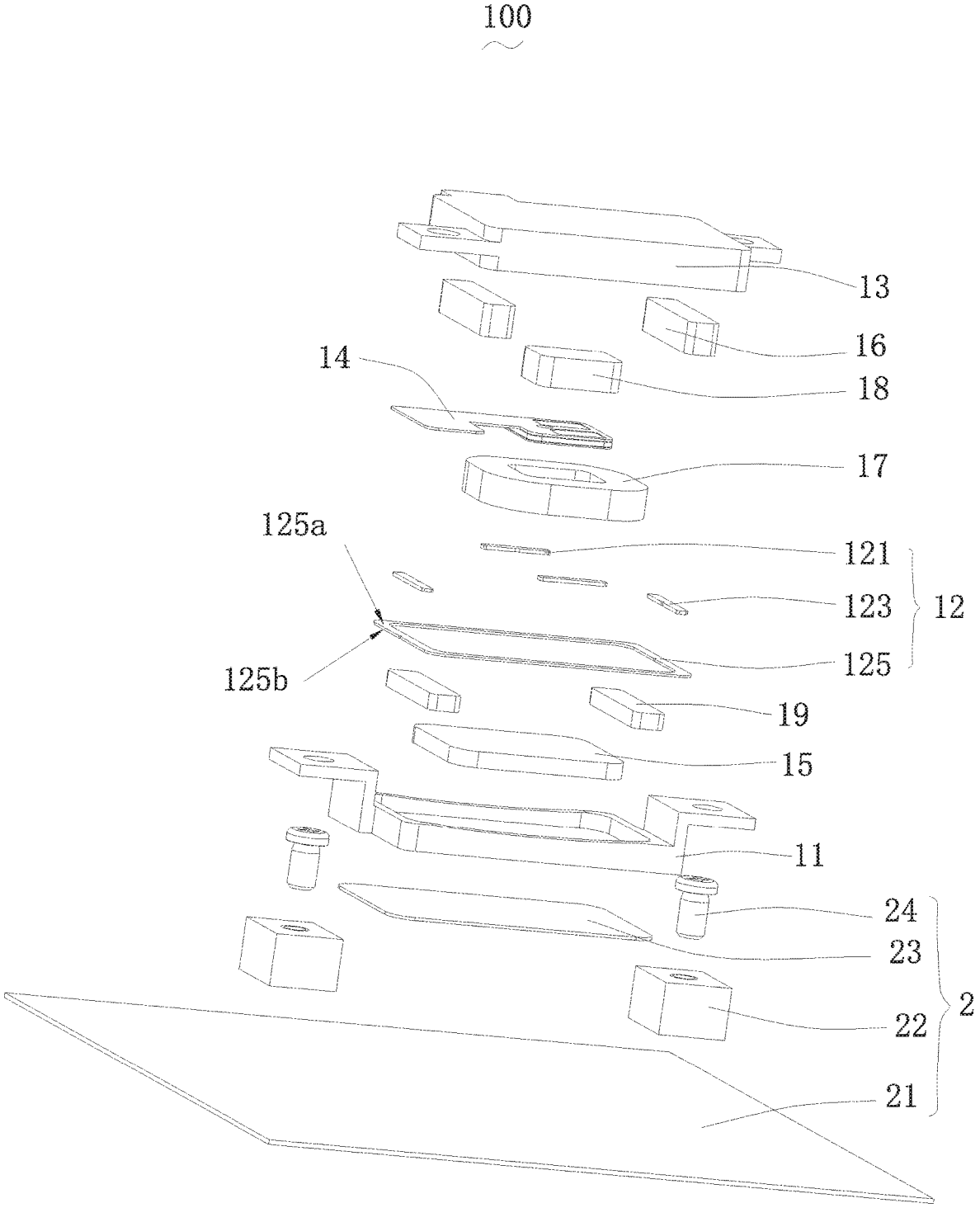
FIG. 2 is an exploded view of the sounding device of FIG. 1.
Figure 3:
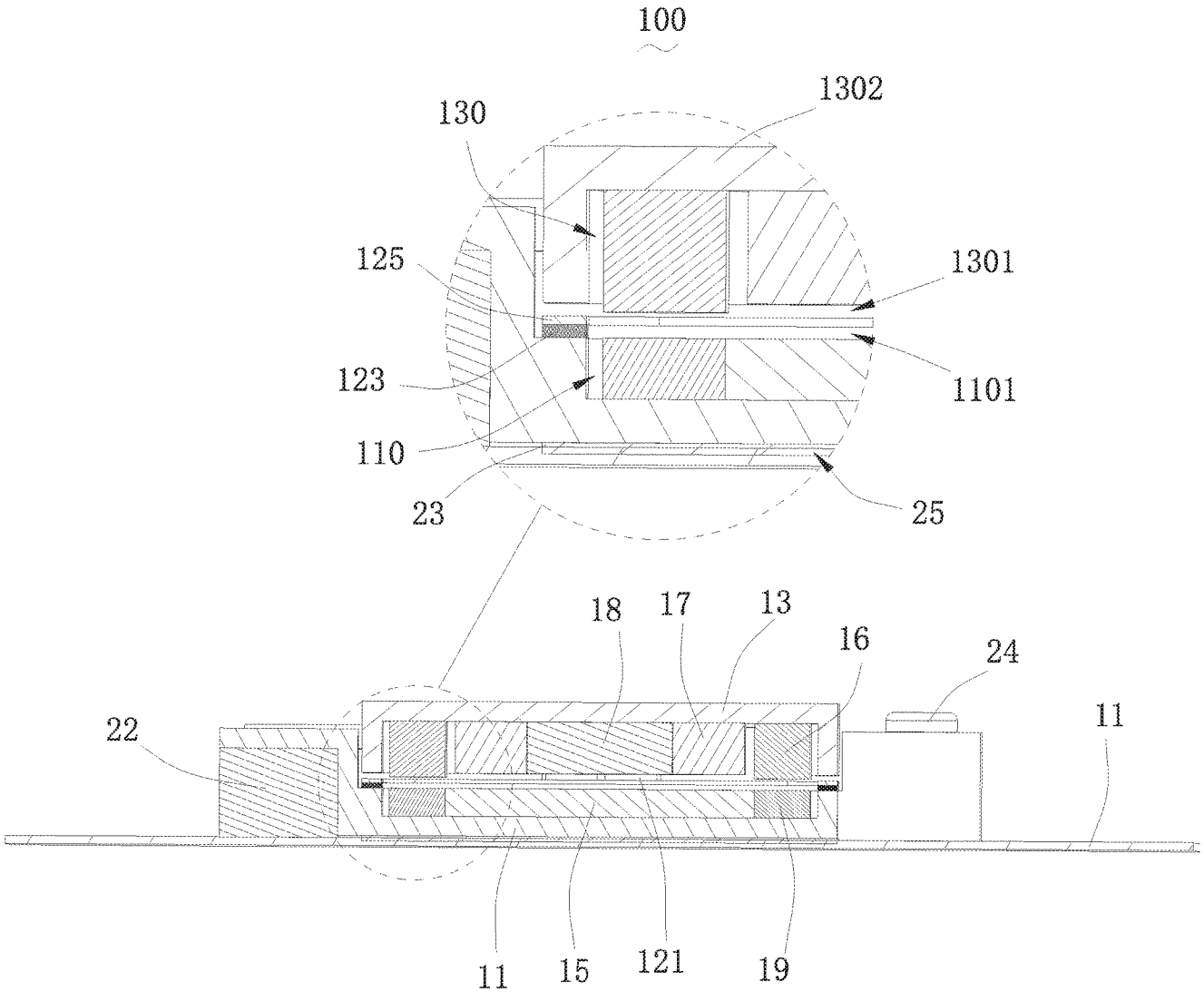
FIG. 3 is a cross-sectional view of FIG. 1, taken along line A-A.

FIG. 1 is a schematic structural diagram of a sounding device provided by the present disclosure, FIG. 2 is a schematic exploded view of the sounding device shown in FIG. 1, and FIG. 3 is a cross-sectional view of FIG. 1, taken along line A-A. Referring to FIGS. 1-3, the sounding device 100 includes a first housing 11 having a first receiving space 110 and a second housing 13 having a second receiving space 130. The second housing 13 is disposed opposite to and spaced apart from the first housing 11. The sounding device further includes a first magnet 15 received in the first receiving space 110, and a second magnet 16 and a coil 17 received in the second receiving space 130. The first housing 11 has a first opening end 1101 facing the second housing 11, and the second housing 13 has a second opening end 1301 facing the first opening end 1101. In some embodiments, the central axis of the first opening end 1101 is aligned with the central axis of the second opening end 1301. The second housing 13 includes an end wall 1302 disposed opposite to the second opening end 1301 and a side wall extending from the periphery of the end wall 1302 and surrounding the second receiving space 130. The sounding device 100 further includes a magnetically conductive core 18 fixed to the end wall 1302, and the coil 17 is wound around the magnetically conductive core 18. The second magnets 16 are disposed on the peripheral side of the coil 17 with a radial gap formed therebetween. The sounding device 100 further includes a third magnet 19 received in the first receiving space 110 and disposed on the peripheral side of the first magnet 15. One of the second housing 13 and the first housing 11 may be fixed to a screen (not shown) of a smart phone. When the coil 17 is energized, the one of the second housing 13 and the first housing 11 fixed to the screen is vibrated in a vibration direction relative to the other of the second housing 13 and the first housing 11 to thereby drive the screen to vibrate and sound. The vibration direction is parallel to the axis of the coil 17 around which the coil 17 is wound.

It should be noted that the first housing 11 and the second housing 13 both are made of material of high magnetic permeability, which can effectively reduce magnetic leakage and achieve high-efficiency magnetic field while avoiding interference with other components.

The third magnet 19 includes two magnets which are arranged on and closely contact with opposite sides of the first magnet 15, respectively.

The second magnet 16 includes two magnets which are disposed on and spaced from the opposite sides of the coil 17, respectively.

The projection of the third magnet 19 in the vibration direction at least partially overlaps the projection of the second magnet 16 in the vibration direction.

The second magnet 16 is magnetized in a direction perpendicular to the vibration direction, and the magnetization directions of the two second magnets 16 are opposite to each other.

The first magnet 15 is magnetized in the vibration direction. The third magnet 19 is magnetized in the direction perpendicular to the vibration direction, and the magnetization directions of the two third magnets 19 are opposite to each other.

The first magnet 15, the second magnet 16, and the third magnet 19 are all permanent magnets.

Figure 4:
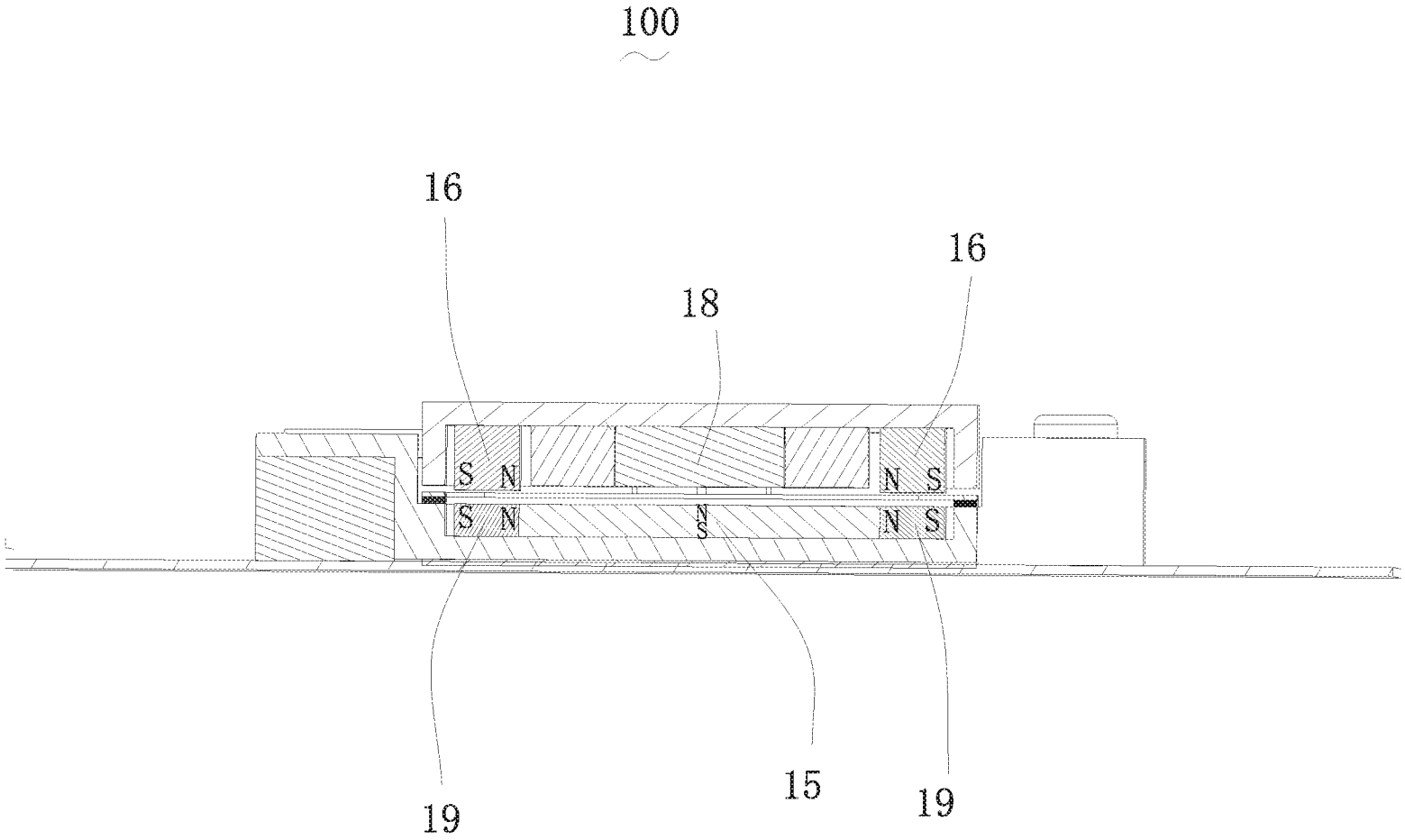
FIG. 4 is similar to FIG. 3, showing magnetization directions of magnets of the sounding device of FIG. 1.

FIG. 4 shows magnetization directions of the magnets of the sounding device. Referring to FIG. 3 and FIG. 4, in this embodiment, by providing the first magnet 15 and the third magnet 19 in the first receiving space 110 and the second magnet 16 in the second receiving space 130, the second magnet 16 magnetizes the magnetically conductive core 18 through the second housing 13 made of material of high magnetic permeability, and the first magnet 15 and the third magnet 19 magnetize the first housing 11, so that a great attractive force exists between the magnetically conductive core 18 and the first housing 11 and the first magnet 15.

Since the two second magnets 16 and the two third magnets 19 are disposed opposite to each other and have the same magnetization direction, a repulsive force is generated therebetween. The repulsive force is balanced with the attractive force generated between the magnetically conductive core 18 and the first housing 11 and the first magnet 15.

Referring to FIG. 2, the sounding device 100 further includes an elastic support member 12 connected between the first housing 11 and the second housing 13 in the vibration direction. The elastic support member 12 includes a first support plate 121 connected with the second housing 13, a second support plate 123 connected with the first housing 11 and a support ring 125 connecting the first support plate 121 and the second support plate 123.

The support ring 125 includes a first surface **125*a* and a second surface 125*b* that are disposed opposite to each other. The first surface 125*a* faces the second housing 13 and the second surface 125*b* faces the first housing 11. The first support plate 121 is fixed to the first surface 125*a* and connected with the second housing 13, and the second support plate 123 is fixed to the second surface 125*b***.

The support ring 125 has a rectangular ring shape with a long axis and a short axis perpendicular to the long axis. The first support plate 121 and the second support plate 123 each include two support plates. The two first support plates 121 are symmetrically fixed to the first surface **125*a* of the support ring 125 along the long axis and connected with the second housing 13, and the two second support plates 123 are symmetrically fixed to the second surface 125*b* of the support ring 125 along the short axis and connected with the first housing 11**.

The first magnet 15 and the third magnets 19 are attached to the first housing 11 to form a first part of the sounding device. The magnetically conductive core 18, the coil 17, and the second magnet 16 are attached to the second housing 13 to form a second part of the sounding device. In this embodiment, the first part is a moving part which is fixed with respect to the screen of a smart phone. The second part is a stationary part which is fixed with respect to the frame of the smart phone. When the coil 17 is energized, the moving part vibrates relative to the stationary part, thereby driving the screen to vibrate and sound. The support ring 125 is an annular spring which connects the two parts of the sounding device, thereby achieving the integrity of the split direct driving type sounding device.

In this embodiment, when the repulsive force generated between the second magnet 16 and the third magnet 19 is greater than the attractive force generated between the magnetically conductive core 18 and the first housing 11 and the first magnet 15, there is still a certain repulsive force between the second housing 13 and the first housing 11, and the elastic support member 12 fixedly connected between the second housing 13 and the first housing 11 will produce elastic deformation to provide a pulling force to balance with the repulsive force. The design of the magnetic circuit and the elastic support member 12 in combination effectively reduce the requirements for screen assembly and realize the applicability of different types of screens, including hard screen, soft screen of organic light emitting display and LCD screen.

The sounding device 100 further includes a flexible circuit board 14 which is electrically connected with the coil 17. After the coil 17 is energized, a Lorentz force is generated on the coil 17 which breaks the original balance of forces and drives the screen which is secured to one of the second housing 13 and the first housing 11 to vibrate and sound.

Referring to FIG. 1, the sounding device 100 further includes a fixing member 2 for fixing the first housing 11. The fixing member 2 includes a fixing plate 21, a limiting block 22, screws 24, and an elastic pad 23 sandwiched between the first housing 11 and the fixing plates 21. The limiting block 22 is fixed to the fixing plate 21 by welding or bonding. The first housing 11 is provided with a mounting hole (not shown), the limiting block 22 is provided with a threaded hole (not shown) corresponding to the mounting hole, and the first housing 11 is fixed to the limiting block 22 by the screws 24 which extend through the mounting holes to engage in the threaded holes respectively.

Referring to FIG. 3, the fixing plate 21 is further provided with a recess 25 for receiving the elastic pad 23. The cross-sectional area of the elastic pad 23 matches the cross-sectional area of the recess 25, the height of the recess 25 is smaller than that of the elastic pad 23, and the elastic pad 23 can effectively reduce wear and damage to the fixing member 2 when the first housing 11 vibrates.

In addition, the present disclosure further provides an electronic device which includes the sounding device 100 described above.

Compared with related art, two parts of the sounding device provided by the present disclosure are connected by a spring, which realizes the integrity of the split direct driving type sounding device, reduces assembly requirement of the screen. The housing made of material of high magnetic permeability reduces the magnetic leakage and achieves high efficiency magnetic field, while avoiding interference with other components. The magnetic circuit using five magnets is applied between the upper and first housings to cause the internal attractive forces of the sounding device to be counteracted with each other, which reduces the assembly requirement for the screen, realizes the applicability of different types of screens, and protects the screen effectively.

The above-described are only embodiments of the present disclosure. It shall be noted that those skilled in the art may make improvements without departing from the spirit or scope of the present disclosure. All these improvements fall into the protection scope of the present disclosure.

What is claimed is:

1. A sounding device comprising:

a first housing having a first receiving space with a first opening end;

a second housing disposed opposite to and spaced apart from the first housing, the second housing having a second receiving space with a second opening end facing the first opening end, the second housing comprising an end wall opposite to the second opening end;

a magnetically conductive core received in the second receiving space and fixed to the end wall;

a coil received in the second receiving space and wound around the magnetically conductive core;

a first magnet received in the first receiving space;

a second magnet received in the second receiving space, the second magnet being located at outside of the coil and spaced apart from the coil, and;

a third magnet received in the first receiving space and disposed on a peripheral side of the first magnet.

2. The sounding device according to claim 1, wherein both the first housing and the second housing are made of magnetic conductive material.

3. The sounding device according to claim 1, wherein when the coil is energized, one of the second housing and the first housing is vibrated in a vibration direction relative to the other of the second housing and the first housing, the vibration direction being parallel to an axis of the coil around which the coil is wound.

4. The sounding device according to claim 3, wherein the second magnet comprises two magnets which are disposed on and spaced from opposite sides of the coil respectively.

5. The sounding device according to claim 4, wherein the second magnet is magnetized in a direction perpendicular to the vibration direction, and the magnetization directions of the two magnets are opposite to each other.

6. The sounding device according to claim 3, wherein a projection of the third magnet in the vibration direction at least partially overlaps a projection of the second magnet in the vibration direction.

7. The sounding device according to claim 6, wherein the third magnet comprises two magnets which are closely arranged on opposite sides of the first magnet respectively.

8. The sounding device according to claim 7, wherein the third magnet is magnetized in a direction perpendicular to the vibration direction, and the magnetization directions of the two magnets are opposite to each other.

9. The sounding device according to claim 3, wherein the first magnet is magnetized in the vibration direction.

10. The sounding device according to claim 1, wherein the sounding device further comprises an elastic support member connected between the first housing and the second housing in the vibration direction.

11. The sounding device according to claim 10, wherein the elastic support member comprises a first support plate connected with the second housing, a second support plate connected with the first housing and a support ring connecting the first support plate and the second support plate.

12. The sounding device according to claim 11, wherein the support ring comprises a first surface and a second surface opposite to each other, the first support plate is fixed to the first surface and connected with the second housing, and the second support plate is fixed to the second surface.

13. The sounding device according to claim 12, wherein the support ring has a rectangular ring shape with a long axis and a short axis perpendicular to the long axis, the first support plate and the second support plate each includes two support plates, the two first support plates are symmetrically fixed to the first surface of the support ring along the long axis of the support ring and connected with the second housing, and the two second support plates are symmetrically fixed to the second surface of the support ring along the short axis of the support ring and connected with the first housing.

14. The sounding device according to claim 11, wherein the support ring is an annular spring.

15. The sounding device according to claim 1, wherein the first magnet, the second magnet, and the third magnet are all permanent magnets.

16. An electronic device comprising a sounding device according to claim 1.

* * * * *